US005567145A

United States Patent [19]

White

[11] Patent Number: 5,567,145

[45] Date of Patent: Oct. 22, 1996

[54] CELEBRATION CANDLE

[76] Inventor: Clifford A. White, 30 Coldwater Tavern Rd., East Nassau, N.Y. 12062

[21] Appl. No.: 444,403

[22] Filed: May 19, 1995

[51] Int. Cl.[6] ..... F23D 3/16

[52] U.S. Cl. ..... 431/288; 431/125; 431/126; 431/289; 431/295

[58] Field of Search ..... 431/288, 289, 431/125, 126, 295

[56] References Cited

U.S. PATENT DOCUMENTS

| | | | |
|---|---|---|---|
| 803,848 | 11/1905 | Pereira | 431/288 |
| 2,223,228 | 11/1940 | Schisano et al. | 431/295 |
| 2,504,211 | 4/1950 | Means | 431/288 X |
| 2,627,174 | 2/1953 | Weglin | 431/288 X |
| 3,826,606 | 7/1974 | Hicks | 431/295 |
| 3,947,232 | 3/1976 | Foster | 431/288 |

FOREIGN PATENT DOCUMENTS

| | | | |
|---|---|---|---|
| 2196017 | 4/1988 | United Kingdom | 431/288 |

*Primary Examiner*—Larry Jones
*Attorney, Agent, or Firm*—Vineet Kohli

[57] ABSTRACT

A candle including a shaped mass of suitable material, such as for example wax or other petroleum by-products solid at room temperature and the like, which provides a source of combustible fuel during burning thereof is disclosed. The shaped mass includes a central portion disposed at a lower part thereof, and a pair of divergent branch portions joined atop the central portion. In the preferred embodiment, upper portions of the branch portions as well as the central portion are preferably disposed substantially in the vertical direction to permit safe and even burning of the candle, and to enhance the aesthetic appeal.

5 Claims, 6 Drawing Sheets

CELEBRATION CANDLE

BACKGROUND OF THE INVENTION

The present invention relates to a candle, and, in particular, to a celebration candle which can be lit by couples on joyous occasions exemplified by weddings, anniversaries etc. The present application also contemplates a method of making the novel candle.

Candles made from wax and similar compounds are well known and have found widespread use for many centuries. Indeed, in ancient times candles were used mainly for illuminating during the night. However, with the discoveries of kerosene, fluorescent and other modern forms of illumination, conventional candles are not used as widely for illumination purposes and as such have lost a substantial market share. Indeed, conventional candles have been unable to compete with newer sources of illumination as have the candles lost the importance in religious and other joyous ceremonies.

Likewise, "candle-light" has been known for eons to provide an ambiance and romantic atmosphere which has not been replicated by other sources to date. To these ends, candles have also been developed which stimulate the olfactory as well as the visual sense. Generally, such candles include fragrant oils which upon burning release a scent containing various "top notes" which are meant to stimulate the olfactory senses. The type of note released depends upon the makeup of the underlying fragrance oils.

Such candles have, however, suffered from serious drawbacks including bulkiness and high cost of manufacture. Indeed, the incorporation of flagrant oil in a quantity sufficient to ensure an abundant release of fragrance has made conventional flagrant candles tacky or oily and generally quite messy. The attendant messiness has in turn, required such candles to be protected by rigid containers including glass, thereby adding to the overall cost of the candle.

In an effort to overcome the aforementioned drawbacks related to prior art flagrant candles, U.S. Pat. No. 4,568,270 contemplates a biconstituent candle, which embraces a free-standing flagrance candle. The publication teaches a flagrance candle that releases an abundance of fragrance into the atmosphere while the candle burns. However, the candle is characterized as being less messy and easier to handle and does not stain or soil.

The above object is achieved by an outer shell, an inner core and a wick. This patent further discloses that the shell is formed from one of paraffin, wax, a mixture thereof together with a fragrant oil. The shell includes a melting point high enough that the shell stands freely at room temperature. The core is characterized as being formed of a fragrance oil wherein the fragrance oil in the core constitutes from 5 to 12 weight percent of the total weight of the core. The carrier, in turn, is formed of a material which is at least one of petroleum, and a low melting point wax. The core has a melting point substantially lower than the melting point of the shell, low enough to form a molten pool within the shell such as to ensure a substantial release of flagrance as the candle burns. The shell includes a container and provides structural support for the core.

Wick-burning candles with multiple points of light emissions contained in their bodies is disclosed in U.S. Pat. No. 3,753,643. This patent contemplates a wick-burning candle which includes a body of conventional moldable, combustible material. The candle is characterized in that it further includes a plurality of light transmitting fibers whose introductory ends are exposed directly to the candle flame and whose light emitting ends are located at distribution points in the periphery of the candle, such that the lighting of the candle causes points of light emission in the candle body to glow. However, this publication fails to suggest or disclose the novel candle of the present invention wherein at least two points are lit, which, upon extinction, light a center wick.

Likewise, U.S. Pat. No. 4,524,408 is directed to a candle holder combination useful for burning an elongated candle floating in water. Similar to the rest of the prior art, this publication is also deficient in suggesting a candle, wherein two wicks are lit, which, upon, extinction light a center wick.

U.S. Pat. No. 3,826,606 envisions a segmented candle having a plurality of wax segments which are disposed in a spaced relation along a continuous wick with a candle holder, The candle holder has at least two vertically spaced support platforms for holding the upper segments of the candle in a fixed relationship.

In view of the longstanding need for candles for effective and entertaining use during joyous occasions, the present invention aims at providing a candle which includes two wicks opposed to each other, wherein after burning and following a burn course, the two wicks intersect at a center wick which is ignited upon extinction of the two wicks. The present invention thus teaches a mechanism to address the issue of providing an alternate, aesthetically pleasant light novice which aids in generating a celebration atmosphere.

OBJECT AND SUMMARY OF THE PRESENT INVENTION

It is an object of the present invention to provide a candle which includes at least two wicks defining a separate burn course, which after burning and upon extinction, together light a central wick.

It is another object of the present invention to provide a method for making the novel candle contemplated by the present invention.

Briefly stated, there is provided a candle including a shaped mass of suitable material, such as for example wax or other petroleum by-products solid at room temperature and the like, which provides a source of combustible fuel during burning thereof is disclosed. The shaped mass includes a central portion disposed at a lower part thereof, and a pair of divergent branch portions joined atop the central portion. In the preferred embodiment, upper portions of the branch portions as well as the central portion are preferably disposed substantially in the vertical direction to permit safe and even burning of the candle, and to enhance the aesthetic appeal.

According to a feature of the present invention, there is provided a candle, which includes a shaped mass which includes a combustible fuel; wick means disposed within the shaped mass for permitting controlled burning of the combustible fuel, wherein the wick means defines a contiguous burn course when ignited; and a portion of the burn course is arranged in angular relationship with a remainder of the burn course.

According to another feature of the present invention, there is provided a candle, which includes a shaped mass including an upper and lower portion, wherein the shaped mass includes at least one combustible fuel. The candle further includes wick means disposed substantially within the shaped mass for permitting controlled burning of the combustible fuel. The wick means includes a wick in the lower portion, and at least one branch wick disposed in the upper portion and extending from the wick at an angle therefrom.

An alternative embodiment contemplates a method of producing a candle, which includes the steps of providing a mold having an interior surface defining a shape which includes portions thereof arranged in angular relation to adjacent portions thereof forming a structural apex on the interior surface at their point of intersection; arranging a wick within the mold; spacing the wick apart from the structural apex; introducing a flowable candle structure material into the mold; followed by allowing the flowable candle structure material to solidify.

According to yet another feature of the present invention, there is provided a mold for producing a candle including a wick, which includes a bisected mold halves collectively defining when joined together an interior surface shape which includes portions thereof arranged in angular relation to adjacent portions thereof forming a structural apex on the interior surface at their point of intersection; inwardly projecting spacing means disposed in at least one of the bisected mold halves proximate the structural apex for isolating the wick from the structural apex.

DETAILED DESCRIPTION

Figure 1:
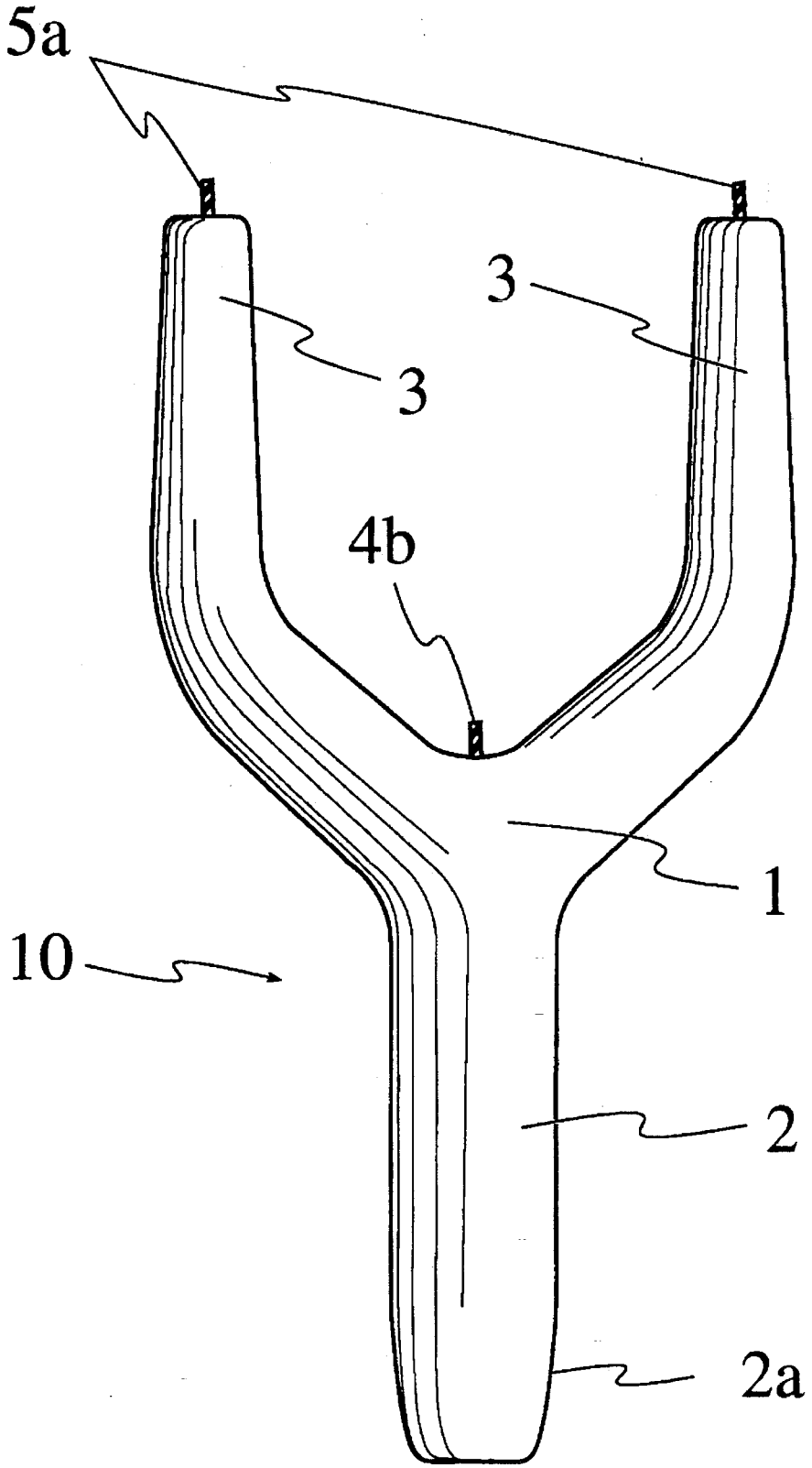
FIG. 1 shows a candle according to an embodiment of the present invention.

Referring now to the figures, and in particular FIG. 1, there is shown, generally at 10, a candle in accordance with the invention. Candle 10 in the embodiment is particularly designed for use as a celebration candle. In ceremonies celebrating the union of two individuals, such a candle may be used to symbolize the joining of two into one. Once lit, two distinct flames, after burning for a time, are consolidated into a single flame which then continues to burn for the remaining duration.

Candle 10 comprises a shaped mass 1 of suitable material, such as for example wax or other petroleum by-products solid at room temperature and the like, which provides a source of combustible fuel during burning thereof. Shaped mass 1 includes a central portion 2 disposed at a lower part thereof, and a pair of divergent branch portions 3 joined atop central portion 2. Although the geometrical shapes of central portion 2 and branch portions 3 is not critical to the invention, in the preferred case these are in accordance with conventionally used candle designs employing generally gradually tapered cylinders (frustroconical), to allow use with standard candle holders during use. A tapered lower end 2*a* allows simplified insertion into a candle holder (not shown). In addition, in the preferred case, upper portions of branch portions 3 as well as central portion 2 are preferably disposed substantially in the vertical direction to permit safe and even burning of candle 10, and to enhance the aesthetic appeal.

Figure 2:
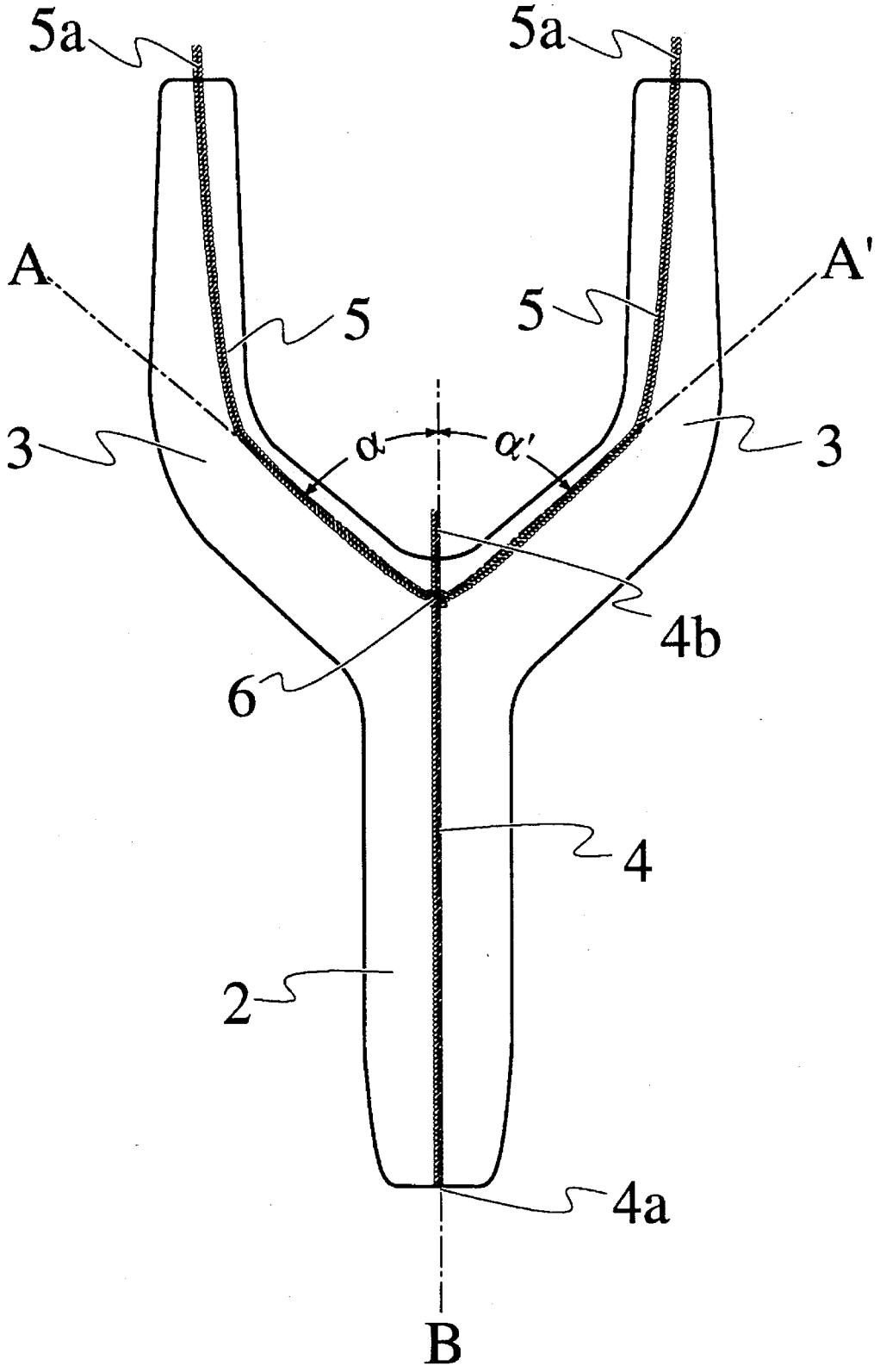
FIG. 2 is a cross section view of the candle shown in FIG. 1.

Referring now to FIG. 2, the embodiment of candle 10 in FIG. 1 is shown in cross-section. Wick means are provided which define a contiguous burn course, in the form of one or more wicks, disposed within shaped mass 1, comprising, in the illustrated embodiment, a central wick portion 4 disposed within central portion 2 and a pair of branch wick portions 5 each disposed within corresponding branch portions 3. Branch wick portions 5 extend beyond upper terminal ends of branch portions 3 as exposed branch wick ends 5*a*, simplifying lighting of candle 10 at the ends of both branch portions 3. As mentioned, branch wick portions 5 and central wick portion 4 together define a contiguous burn course when exposed branch wick ends 5 are lit simultaneously.

Branch wick portions 5 extend at divergent angles $\alpha$, $\alpha'$ with respect to central wick portion 4. In the preferred case, candle 10 is bilaterally symmetric, with angles $\alpha$, $\alpha'$ being equal to each other. In addition, although angles $\alpha$, $\alpha'$ may be any acute angle, and angle of about 45° is preferred. Branch wick portions 5 are disposed at lower ends thereof along an axis divergent from an axis of central wick portion 4, intersecting with central wick portion 4 at a common point of intersection 6. In the preferred case, intersection point 6 is located at a point below a terminal end 4*b* of central wick portion 4.

By having terminal end 4*b* extend upwardly from shaped mass 1, more reliable placement of the burn course can be insured during manufacture by permitting fixation of central wick portion at both ends thereof.

For purposes of this disclosure, a contiguous burn course means that once lit, candle 10 will continue to burn in an uninterrupted manner from the ends that are lit, along the burn course, terminating at a lowermost wick end 4*a* of central wick portion 4. In the preferred case, lowermost central wick portion 4 extends substantially through the length of central portion 2, with lowermost wick end 4*a* being disposed at a terminal end of central portion 2. It is noted however that central wick portion 4 need only extend partially downward from intersection point 6 within central portion 2, which would permit burning of only a partial length thereof, if so desired. It is further noted that although shaped mass 1 includes independent branch portions 3 separated from one another in the preferred case, insofar as the position of the flames are determined by the placement of the wick means within shaped mass 1, no such branch portions 3 are necessary.

For example, shaped mass 1 may instead be of uniform diameter over its length, including a pair of wicks separated from one another in an upper portion of the candle, the pair of wicks converging into a unitary burn course at a lower portion thereof. Numerous other configurations are also possible.

As noted above, the wick means which provide the contiguous burn course when lit can be a single, integrated wick having upper branches divergent from a lower portion, or may rather be comprised of separate wicks which converge within sufficient proximity of one another to allow the upper wick to ignite the lower, unlit wick. These various embodiments will be discussed in greater detail below.

Figure 3:
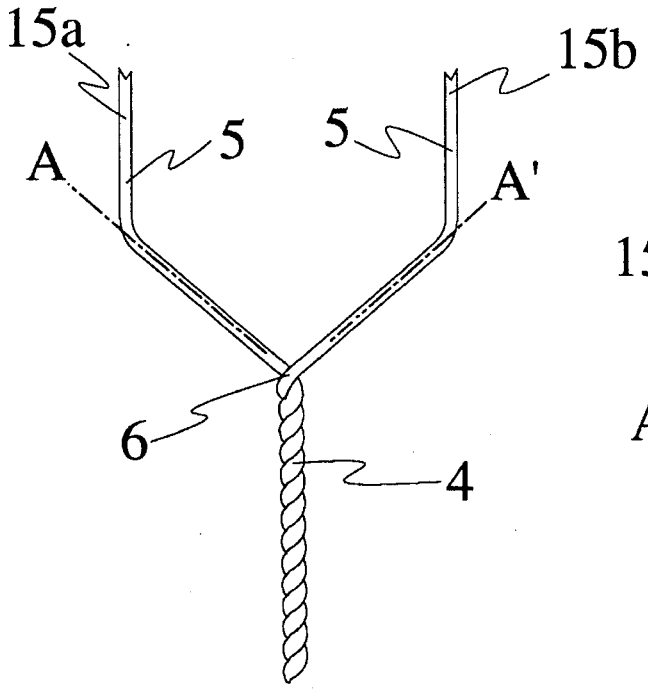
FIG. 3 shows an embodiment according of a candle wherein a pair of wick members are intertwined, at a portion thereof to form a central wick portion, and branch off in separate directions to define branch wick portions.

Referring now to FIG. 3, an embodiment is illustrated in which a pair of wick members 15*a* and 15*b* are intertwined, at lower portions thereof to form central wick portion 4, and branch off in separate directions at upper portions thereof to define branch wick portions 5. In this manner, point of intersection 6 is that point at which wick members 15*a* and 15*b* are no longer intertwined.

Figure 4:
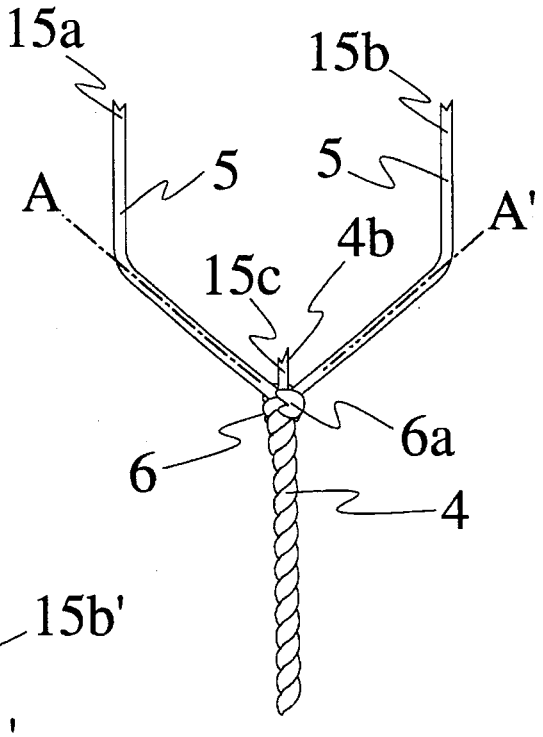
FIG. 4 shows an other embodiment of a candle illustrating a burn course of the candle in FIG. 1.

FIG. 4 illustrates a further embodiment, in which terminal end 4*b* is provided to permit more accurate placement of the burn course, as described above with reference to FIG. 1. This embodiment is similar to that shown in FIG. 3, with the addition of another wick member 15*c*, intertwined with wick members 15*a* and 15*b* all at lower portions thereof, to define central wick portion 4. In the preferred case, wick members 15*a*, 15*b* and 15*c* are tied together in a knot 6*a* at intersection point 6 to prevent separation thereof during wick placement and to insure the union of two flames into a single flame as the branch wick portions burn down and approach intersection point 6 during use. An upper portion of wick member 15*c* extends above knot 6*a* defining terminal end 4*b*. As with FIG. 3, upper portions of wick members 15*a* and 15*b* diverge above intersection point 6 to define branch wick portions 5.

Figure 5:
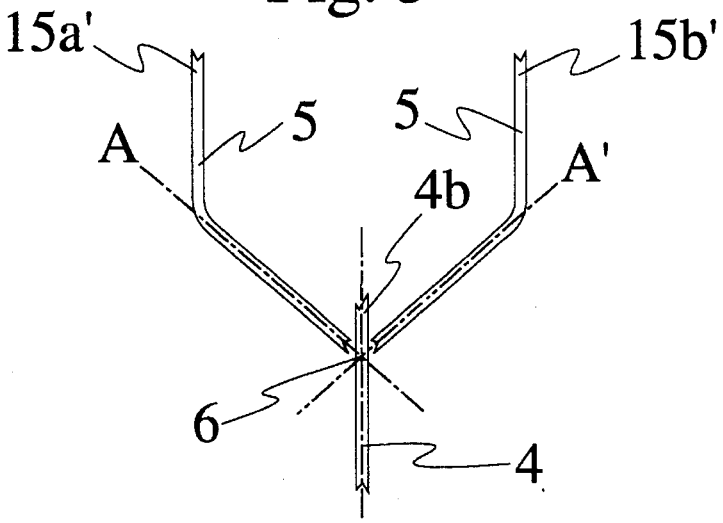
FIG. 5 shows another embodiment of a burn course.

FIG. 5 is directed to an embodiment in which the burn course is defined by a plurality of wick members 15*a*', 15*b*' and 15*c*' which lie along axes A, A' and B having a common point of intersection defined by intersection point 6. Wick members 15*a*' and 15*b*' define branch wick portions 5, and wick member 15*c*' defines central wick portion 4. An upper portion of wick member 15*c*' above intersection point defines terminal end 4*b*. Although not physically contiguous, wick members 15*a*', 15*b*' and 15*c*' are sufficiently proximate with one another at intersection point 6 to permit igniting of wick member 15*c*' by either of wick members 15*a*' and 15*b*', thereby providing a contiguous burn course within its meaning in compliance with the object of the invention.

Placement of branch wick portions 15 within branch portions 3 may affect candle strength and vary the evenness of burning when in a portion of the burn course defined by a portion of the wick means oriented in other than vertical position.

Referring to FIG. 2, it is noted that in an advantageous embodiment, lower portions of branch wick portions 5 which are aligned with axes A and A' in angular relation with axis B of central wick portion 4 are proximate an upwardly facing surface of branch portions 3 of shaped mass 1. This increases rigidity of branch portions 3 and provides an even burn over this region, compared with central placement of branch wick portions 5 within branch portions 3.

The above embodiment, is directed to a celebration involving the union of two separate entities, finding use in weddings, anniversaries, business mergers and the like. It is noted, that by providing a burn course, a portion of which is arranged in angular relationship with a remainder of the burn course, numerous other embodiments will be contemplated.

For example, where more than two parties are involved, multiple branched portions in excess of two may be used with equal effect by employing equivalent structure, without departure from the invention. Further, it may be desirable to employ the principles set forth herein in the production of various novelty candles, having burn courses defined by a single branch extending in angular relation to a lower central wick. In addition, the multiple branches need not be disposed in an uppermost position as in the embodiment described with respect to the invention's use as a celebration candle. For example, a candle having a single central portion in an uppermost position, and a pair of branches divergent from a lower end of the central portion could be used to celebrate a festive separation, during going away parties, etc.

As with conventionally shaped candles, any material presently used in the manufacture thereof will be suited to the present application. For example, the many scented and non-scented waxes, in various colors will be acceptable from which to fabricate the shaped mass of the candle. In addition, dripless wax may be used with effective results. Similarly, any number of available type wick materials may be used in construction of the present invention in its various embodiments. Burn time of the actual candle produced in accordance with the invention will be determined by parameters including the characteristics of the type of wax used, wick diameter, length of the candle portions, and diameters thereof.

METHOD

Figure 6:
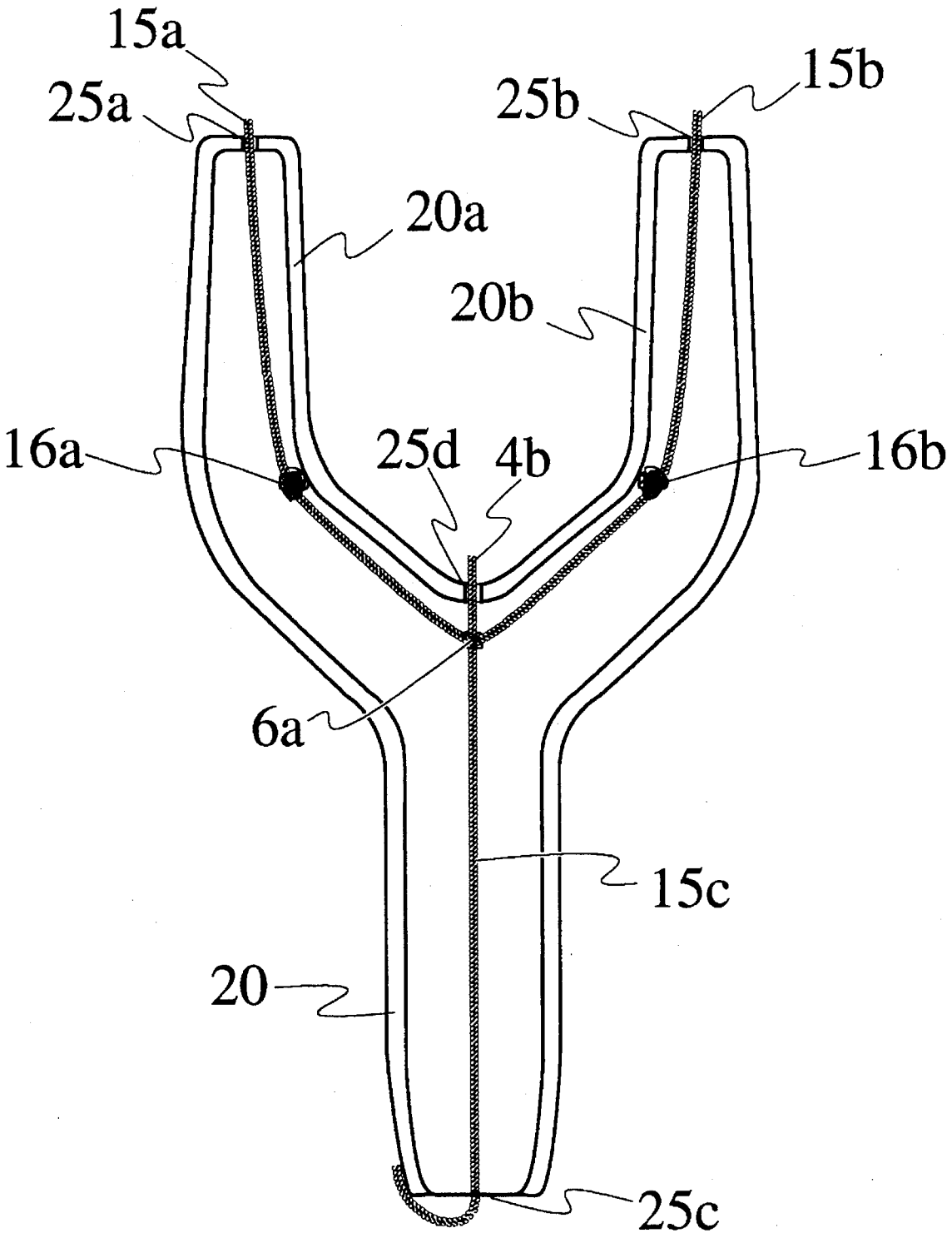
FIG. 6 shows a mold for producing the candle shown in FIG. 1.

A candle in accordance with the invention will conveniently be produced in a mold of suitable shape. Turning to FIG. 6., a mold 20 comprises bisected halves, each having a shape substantially the mirror image of the other, together defining an interior shape of the desired candle when joined, of which only one of the halves is illustrated. In this embodiment, mold 20 is for production of a candle of the version for use in the celebration of the union of two entities, as previously described.

It is noted that production of a candle of any shape in accordance with the invention introduces a special consideration due to need for a portion of the wick to be arranged in angular relation to an adjacent remaining portion of the wick. In a conventional candle having a continuously linear burn course, a wick may simply be stretched taut between opposed ends thereof, in order to assure centering thereof in the shaped mass of wax. In the present invention however, means must be provided to insure that the wick will be surrounded by wax or other suitable candle mass material at all portions along its length, particularly at points where the burn course diverges at an angle from an adjacent portion thereof.

In the embodiment illustrated in FIG. 6, these are provided in the form of knots 16*a* and 16*b* tied in wick members 15*a* and 15*b* at points corresponding to bends along the burn course. Knots 16*a* and 16*b* having an outer diameter larger than the adjacent wick members 15*a* and 15*b* act as spacers to keep wick members 15*a* and 15*b* separated from inner walls 20*a* and 20*b* of upper branch portions of mold 20, thereby insuring proper flow of wax or the like around wicks members 15*a* and 15*b* at the point of angular deviation during manufacture. The configuration of the wick of the present embodiment is identical in all other respects to the embodiment described with regard to FIG. 4.

In order to produce a candle using mold 20, the following procedure may preferably be practiced. Wick members 15*a*, 15*b* and 15*c* are intertwined in a manner as described in the embodiment illustrate in FIG. 4. In this regard, knot 6*a* is tied below terminal end 4*b*, joining all three wick members into a single wick as discussed. Additional knots 16*a* and 16*b* are tied in each of wick members 15*a* and 15*b* at locations thereon corresponding to points of angular deviation.

The wick, comprised of wick members 15*a*, 15*b* and 15*c*, is placed in the open half of mold 20. The free ends of wick members 15*a* and 15*b* are fed through openings 25*a* and 25*b* in mold 20, respectively. The opposed end of wick member 15*c* and terminal end 4*b* are similarly fed though an opening 25*c* and an opening 25*d*, respectively, formed in opposed ends of the central portion of mold 20.

Each half of mold 20 preferably includes matching bisected portions of openings 25*a* and 25*b* and opening 25*c*, thereby simplifying threading of wick members 15*a*, 15*b* and 15*c* therethrough, as well as facilitating removal of the finished candle from mold 20. The ends of wick members 15*a*, 15*b* and 15*c* and terminal end 4*b* are affixed to an adjacent outer surface of mold 20 by for example tape, clamping means, or the like, taking care that the entire wick is taut over all segments thereof, that knots 16*a* and 16*b* are properly positioned at bends in upper arms of mold 20, and that knot 6*a* is sufficiently below the inner wall of mold 20 surrounding opening 25*d* to allow the flow of wax therebetween during production. The matching half of mold 20 is then joined to the matching half thereof in which the wick is arranged, and the union therebetween secured by suitable means, including for, example taping, clamping, etc.

A relatively tight seal is essential to prevent leakage of molten wax during pouring thereof into mold 20. Similarly, any gaps between upper ends of wick members 15*a* and 15*b* and openings 25*a* and 25*b*, and between and between terminal end 4*b* and opening 25*d* should be sealed prior to candle production to prevent leakage. Opening 25*c* has a diameter substantially greater than the central portion of the wick extending therethrough, to serve as an opening through which the wax or like material is to be poured. Mold 20 is inverted with opening 25*c* in an uppermost position, and molten wax is poured slowly into opening 25*c* surrounding the wick extending therethrough, to insure complete and even flow of the material throughout mold 20.

The candle in mold 20 is allowed to cool and subsequently removed. In the preferred case, mold 20 is dipped in hot water to facilitate removal of the candle. Alternatively, the inside of both halves of mold 20 may be coated with a suitable release agent designed for this purpose prior to pouring.

Figure 7:
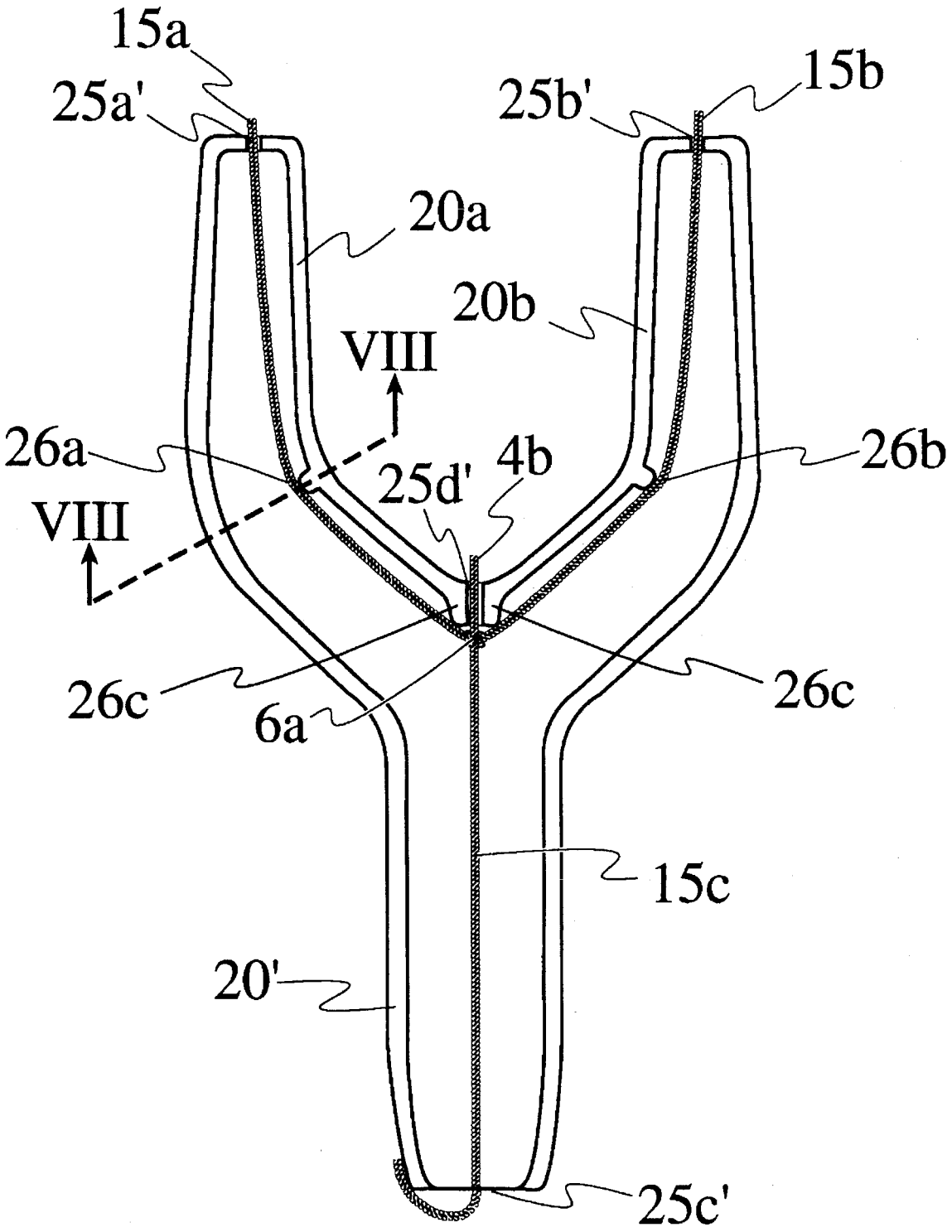
FIG. 7 shows another embodiment of a mold for producing a candle shown in FIG. 1.

Turning now to FIG. 7, a further embodiment of a mold in accordance with the invention is illustrated, generally designated 20'. Mold 20' is identical in all respects to mold 20 described in the previous embodiment, with the added feature that mold 20' provides in its structure means for spacing the wick apart from the inner walls of mold 20' at points of angular divergence, rather than relying on knots in the wick to achieve this end.

These are provided in the form of retainer nipples 26*a* and 26*b* disposed on the inner surface of the branch portions of mold 20' positioned proximate the structural apex of the inner surface at the meeting point of the angularly related paths. Another retainer nipple 26*c* surrounds opening 25*d'* in the top of the central portion of mold 20' to prevent excessive upward positioning of the point of convergence of wick members 15*a*, 15*b* and 15*c* at knot 6*a*. It is noted that the wick shown in this embodiment for purposes of disclosure is identical with that described with reference to FIG. 4. However, the wick embodiment of FIG. 3 may alternatively be used with substantially similar results.

Retainer nipples 26*a* and 26*b* project inwardly from the inner surface of mold 20' and are of suitable shape to engage wick members 15*a* and 15*b* respectively to keep them spaced apart from the inner surface at the bending point within mold 20'.

Figure 8A:
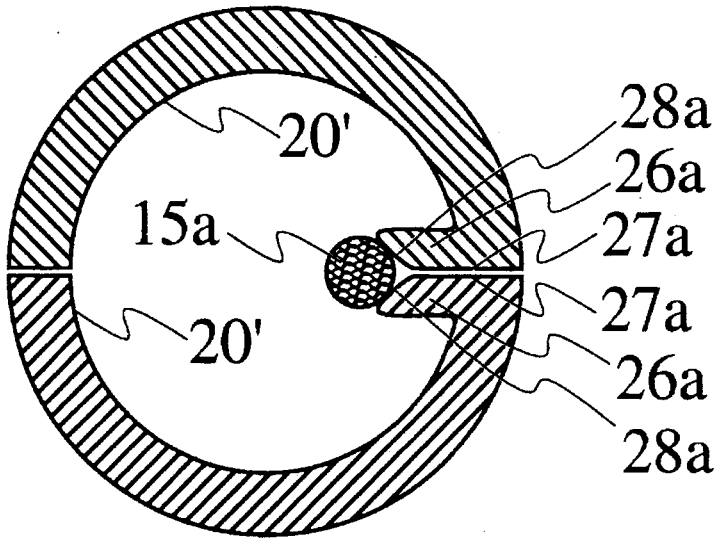
FIGS. 8*a* and 8*b* are cross-sections taken along line VIII—VIII in FIG. 7, showing joined bisected halves of the mold, and detailing alternate embodiments of retainer nipples.
Figure 8B:
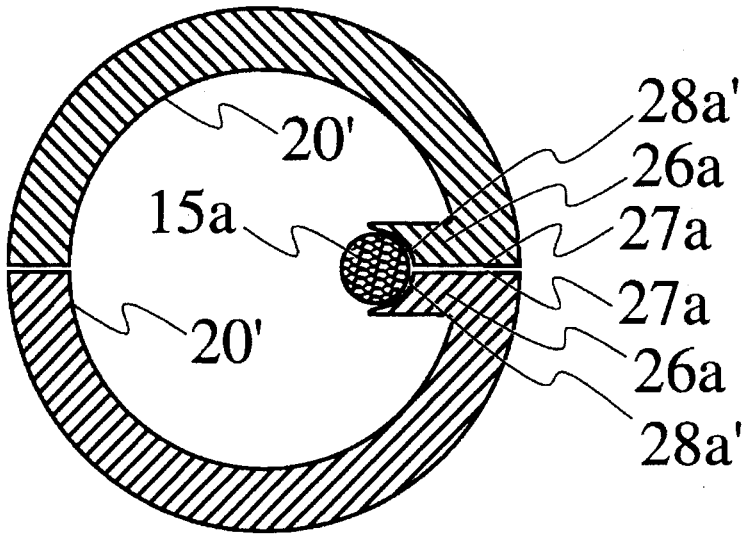

Referring to FIGS. 8*a* and 8*b*, two advantageous examples of suitable shapes for retainer nipples 26*a* and 26*b* are illustrated (retainer nipple 26*b*, not shown, is shaped equivalently to depicted retainer nipple 26*a*).

FIG. 8*a* and 8*b* are cross-sections taken along line VIII—VIII in FIG. 7, showing joined bisected halves of the mold, and detailing alternate embodiments of retainer nipples.

In an embodiment shown in FIG. 8*a*, each retainer nipple 26*a* carried on opposed interior surfaces of bisected halves of mold 20' includes a straight base portion 27*a* and slanted portion 28*a* at an inwardly facing end thereof.

Alternately, as depicted in FIG. 8*b*, each retainer nipple 26*a* may have a curved or cup-shaped end 28*a'* in place of slanted portion 28*a* in FIG. 8*b*. In each of the above embodiments, shown in FIGS. 8*a* and 8*b*, slanted portion 28*a* and cup-shaped end 28*a'* grasp wick members 15*a* and 15*b* (only wick member 15*a* being shown) therebetween to discourage lateral movement away from a desired positioning.

Referring again to FIG. 7, retainer nipple 25*c* similarly extends downward into the interior of mold 20' from the inner surface adjacent to opening 25*d'*. In an embodiment, retainer nipple 25*c* has an annular or partially annular shape, and may include the slanted or cup-shaped configuration of the previously described embodiments when viewed in cross-section, for stable reception of knot 6*a* therein.

The procedure followed in production of a candle using mold 20' is much the same as that described with regard to the previously described mold embodiment of FIG. 6. As with the prior embodiment, appropriate end of the wick is fed through openings 25*a'*, 25*b'*, 25*c'* and 25*d'* in mold 20'. The only difference is that when the wick is pulled taut in mold 20', retainer nipples assure proper location of the burn course within the shaped candle mass when produced. Consequently it is not necessary to determine correct placement of spacer knots in wick members 15*a* and 15*b*, simplifying manufacture. In addition, when removed from mold 20', the candle will have untilled indentations where retainer nipples 26*a*, 26*b* and 26*c* extended into the interior mold 20'. These may be cosmetically filled with wax or the like to match the adjacent area of the candle, following removal of the finished candle from mold 20'. In is noted that in designing retainer nipples 26*a*, 26*b* and 26*c*, it is therefore desirable to minimize the sizes thereof to prevent excessively large voids in the wax mass which might weaken the structure of the shaped mass of the candle.

What is claimed:

1. A candle comprising:

a shaped mass including an upper and lower portion, said shaped mass including combustible fuel;

wick means disposed substantially within said shaped mass for permitting controlled burning of said combustible fuel; and said wick means including a wick in said lower portion, and at least one branch wick disposed in said upper portion and extending from said wick at an angle therefrom, wherein said wick is substantially vertical and said at least one branch wick includes a pair of branch wicks, each of said pair substantially symmetrically divergent from said wick;

said pair of branch wicks extends from said wick at a point below a top of said wick;

said pair of branch wicks extend into said lower portion proximate said wick;

said wick and said pair of branch wicks are knotted together at said point below said top of said wick.

2. The candle according to claim 1, further comprising:

a knot in said wick means disposed approximately at a point of intersection between said portion and said remainder of said burn course.

3. A mold for producing a candle including a wick, comprising:

bisected mold halves collectively defining when joined together an interior surface defining a shape which includes portions thereof arranged in angular relation to adjacent portions thereof forming a structural apex on said interior surface at their point of intersection;

inwardly projecting spacing means disposed in at least one of said bisected mold halves proximate said structural apex for isolating said wick from said structural apex.

4. The mold according to claim 3, wherein said inwardly projecting spacing means includes a retainer nipple.

5. The mold according to claim 4, wherein said retainer nipple includes a shape having a flattened base and one of a slanted and cup-shaped end portion.

* * * * *